US006675760B1

(12) United States Patent
Gährken et al.

(10) Patent No.: US 6,675,760 B1
(45) Date of Patent: Jan. 13, 2004

(54) CYLINDER HEAD

(76) Inventors: Otmar Gährken, Kappenberger Damm 247A, D-48151, Münster (DE); Martin Wessel, Hammer Strasse 132, D-48153, Münster (DE)

( * ) Notice: Subject to any disclaimer, the term of this patent is extended or adjusted under 35 U.S.C. 154(b) by 0 days.

(21) Appl. No.: 09/602,260

(22) Filed: Jun. 23, 2000

(30) Foreign Application Priority Data

Jun. 24, 1999 (DE) ..... 199 28 838

(51) Int. Cl.[7] ..... F02F 1/24

(52) U.S. Cl. ..... 123/193.5; 123/193.3; 123/169 PA; 123/169 P

(58) Field of Search ..... 123/193.5, 193.3, 123/169 PA, 169 EC, 169 P

(56) References Cited

U.S. PATENT DOCUMENTS 5,033,426 A * 7/1991 Reichenbach et al. ... 123/193.3
5,295,462 A * 3/1994 Barnes et al. ..... 123/193.5
5,609,129 A * 3/1997 Hauf et al. ..... 123/193.5
5,685,282 A * 11/1997 Murata et al. ..... 123/169 PA
5,704,330 A * 1/1998 Tsuchida ..... 123/193.5
5,706,847 A * 1/1998 Strait et al. ..... 123/169 PA
5,875,754 A * 3/1999 Ickinger ..... 123/193.5
5,979,387 A * 11/1999 Strait et al. ..... 123/169 PA
6,138,637 A * 10/2000 Bubeck ..... 123/169 PA
6,149,336 A * 11/2000 Bartley et al. ..... 123/169 PA
6,170,451 B1 * 1/2001 Moriya ..... 123/169 PA
6,202,617 B1 * 3/2001 Takahashi ..... 123/193.5
6,209,506 B1 * 4/2001 Satou ..... 123/193.5
6,216,679 B1 * 4/2001 Skinner et al. ..... 123/169 PA
6,237,578 B1 * 5/2001 Satoo et al. ..... 123/169 PA

FOREIGN PATENT DOCUMENTS

DE 36 01 274 C2 7/1986

* cited by examiner

*Primary Examiner*—Henry C. Yuen
*Assistant Examiner*—J A Benton
(74) *Attorney, Agent, or Firm*—McGlew and Tuttle, P.C.

(57) ABSTRACT

A cylinder head of an internal combustion engine is disclosed with an upwardly open spark plug tube (1), a connection thread (6) present on the end of the spark plug tube for screwing the spark plug into the cylinder head (3) and with a sleeve (2), which is inserted into the spark plug tube and accommodates the spark plug. The spark plug tube is provided with an increased diameter (D) cut through at right angles to a longitudinal direction thereof. A process for manufacturing such a cylinder head is described, in which the internal diameter (d) of the spark plug tube (1) is first increased to a diameter (D) that is larger than the external diameter of the sleeve (2) by a material-removing process, the spark plug tube (1) is subsequently cut through at right angles to its longitudinal direction, and the sleeve (2), wetted with the permanently elastic sealant, is finally inserted into the spark plug tube (1) and is adjusted therein.

14 Claims, 3 Drawing Sheets

CYLINDER HEAD

FIELD OF THE INVENTION

The present invention pertains to a cylinder head of an internal combustion engine with at least one spark plug tube per cylinder, wherein the spark plug tube has an end area facing the combustion chamber of the engine with a connection thread for screwing a spark plug into the said cylinder head and an adjoining area with increased diameter, which area is open toward the outside of the engine.

BACKGROUND OF THE INVENTION

The cylinder head of internal combustion engines seals the working space of the cylinder and transmits part of the thermal energy generated during the combustion to the coolant circulating in the cylinder head in order to thus limit the temperatures of the components as a whole.

The cylinder head is subject to mechanical stresses due to pretensioning and gas forces and to thermal load due to the combustion. The pretensioning forces of the cylinder head originate from the screw connection with the cylinder block, while the gas forces are caused by the combustion in the combustion chamber, which are thus also responsible for the thermal heating of the components.

In addition, the cylinder head is responsible for a considerable portion of the gas exchange of the combustion process and accommodates the intake and exhaust valves and, in gasoline engines or gas-operated diesel engines, the spark plug of every cylinder.

High-performance engines of modern design now usually have a plurality of intake and exhaust valves. The valves, which comprise a valve head and a valve shaft each, are sealingly in contact with a valve seat, which is milled into the cylinder head. The respective intake and exhaust channels of the engine are arranged downstream of the valve head.

To prevent leaks of the valve seat, which are caused by a one-sided wear of valve areas subject to increased stress, the valves are often arranged rotatably on engines of prior-art designs, so that they perform a small rotary movement, which usually takes place during the opening of the valve, during each stroke.

In addition, it may happen for various reasons that the valves do not seal one hundred percent, because, e.g., the central axis of the valve is located outside the central axis of the valve seat ring as a consequence of existing inaccuracies in manufacturing or installation, i.e., there is an offset or the valve seat is damaged.

Regrinding or milling of the valve seats in the cylinder head is necessary in case of greater wear or damage, such as scars or impacted areas. In extreme cases, the valve as well as the valve seat ring must be replaced. This is not only expensive, but also complicated.

Another problem arises for proper valve seating from the fact that current cylinder heads of internal combustion engines are made mostly of aluminum. This material shows an increased tendency to nonuniform material expansions, so that the cylinder head and, last but not least, the valve seat rings are warped along with it. This problem arises especially after a cold start of the engine. In particular, the parts of the cylinder head in the combustion chamber are now subject to high thermal loads.

Another of the possible causes of this undesired deformation of the valve seat rings can be seen in the spark plug tube present in the cylinder head. The spark plug tube is a mounting opening for the spark plug of the engine and is therefore needed on each cylinder head in which a spark plug is present. The spark plug tube may consist of a material different from that of the cylinder head, but in most cases it is milled directly into the cylinder head during the manufacture of the cylinder head in the form of a hole or recess. It makes it possible to accommodate the spark plugs and to make same accessible, and it must therefore also have an opening on one side.

The valve seat rings are inevitably arranged in the immediate vicinity of the thread of the spark plug because of the short distances between the valves. The individual assembly groups are proportional and show no warping in the cold state of the cylinder head. Consequently, they are 100% dimensionally accurate. During heating after the start-up of the internal combustion engine, the material of the cylinder head is subject to locally greatly different expansions. This in turn causes a nonuniform deformation of the valve seat rings as well, and it is consequently the cause of the so-called "cold stall effect."

The valves become leaky, and the problem of depositions in the area of the leaky areas leads to accelerated wear of the valves and also of the valve seat ring. Even though the above-mentioned effect is equalized during uniform heating, e.g., longer operating time of the engine, the increased wear phenomena occurring in the valve seat area during the cold start phase may lead, on the whole, to premature failure of the engine.

SUMMARY AND OBJECTS OF THE INVENTION

The primary technical object of the present invention is to develop a cylinder head in which nonuniform deformation of the valve seat rings is extensively avoided. In addition, a process shall be provided that makes possible the manufacture of such a cylinder head.

To accomplish the technical object, it is proposed that on a cylinder head of an internal combustion engine with at least one spark plug tube per cylinder, in which the spark plug tube has an end area facing the combustion chamber of the engine with a connection thread for screwing in a spark plug in the cylinder head and an adjoining area with increased diameter, which said area is open toward the outside of the engine. The spark plug tube is designed such that it is cut through at right angles to its longitudinal direction.

Due to the cutting through at right angles to the longitudinal direction, the expansion of the cylinder head does not affect the spark plug tube, so that deformation of the valve seats is thus also avoided.

Using the solution being proposed here, it is now possible, for the first time ever, to equip both new cylinder heads and engines already in operation with such devices and thus to guarantee satisfactory operation both during the cold start phase and the hot running of the engine. The valve seats are not deformed any more, and the engine is subject to wear in considerably longer lifecycles only. A very inexpensive variant of the processing of old engines and of the improvement of new engine systems has thus been made possible.

Thus, it is also proposed according to the invention being presented here that a sleeve be inserted in the spark plug tube and that this sleeve be fastened in the spark plug tube by means of a permanently elastic sealant. The permanently elastic sealant makes possible the expansion of the cylinder head and of the spark plug tube to a limited extent without the components mutually affecting one another. The permanently elastic sealant, which may be manufactured, e.g., on the basis of a thermally loadable silicone, is thus used to compensate the different deformations of the corresponding cylinder head areas as a consequence of their different thermal expansions. At the same time, the sleeve seals the spark plug tube cut through against the escape of coolant in conjunction with the permanently elastic sealant if a coolant-carrying cavity of the engine block is touched during the cutting through.

Since the cross section of the spark plug tube must be increased for the sleeve to be able to be inserted into it, it is proposed in another embodiment of the present invention that the sleeve be provided with a length that corresponds to the length of the spark plug tube, so that the difference in diameters is again compensated and there is consequently no reduction in cross section in this sensitive area of the cylinder head, which could possibly lead to destruction of the cylinder head.

The process according to the present invention comprises the process steps described below. According to this process, the internal diameter of the spark plug tube is first increased by a material-removing process to a diameter that is greater than the external diameter of the sleeve. Machining processes as they are known per se may be used as the material-removing processes. The spark plug tube is subsequently cut through at right angles to its longitudinal axis, which is followed by the insertion of the sleeve into the spark plug tube, the sleeve being provided with the permanently elastic sealant. This permanently elastic sealant also has the advantage that the tightness of the cylinder head continues to be guaranteed as before, i.e., no coolant can escape.

The process according to the present invention as well as a cylinder head according to the solution being presented can be integrated in the motor vehicle manufacturing cycles without problems, without any greater changes being necessary in the course of the manufacture. In addition, the retrofitting of old cylinder heads is possible.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
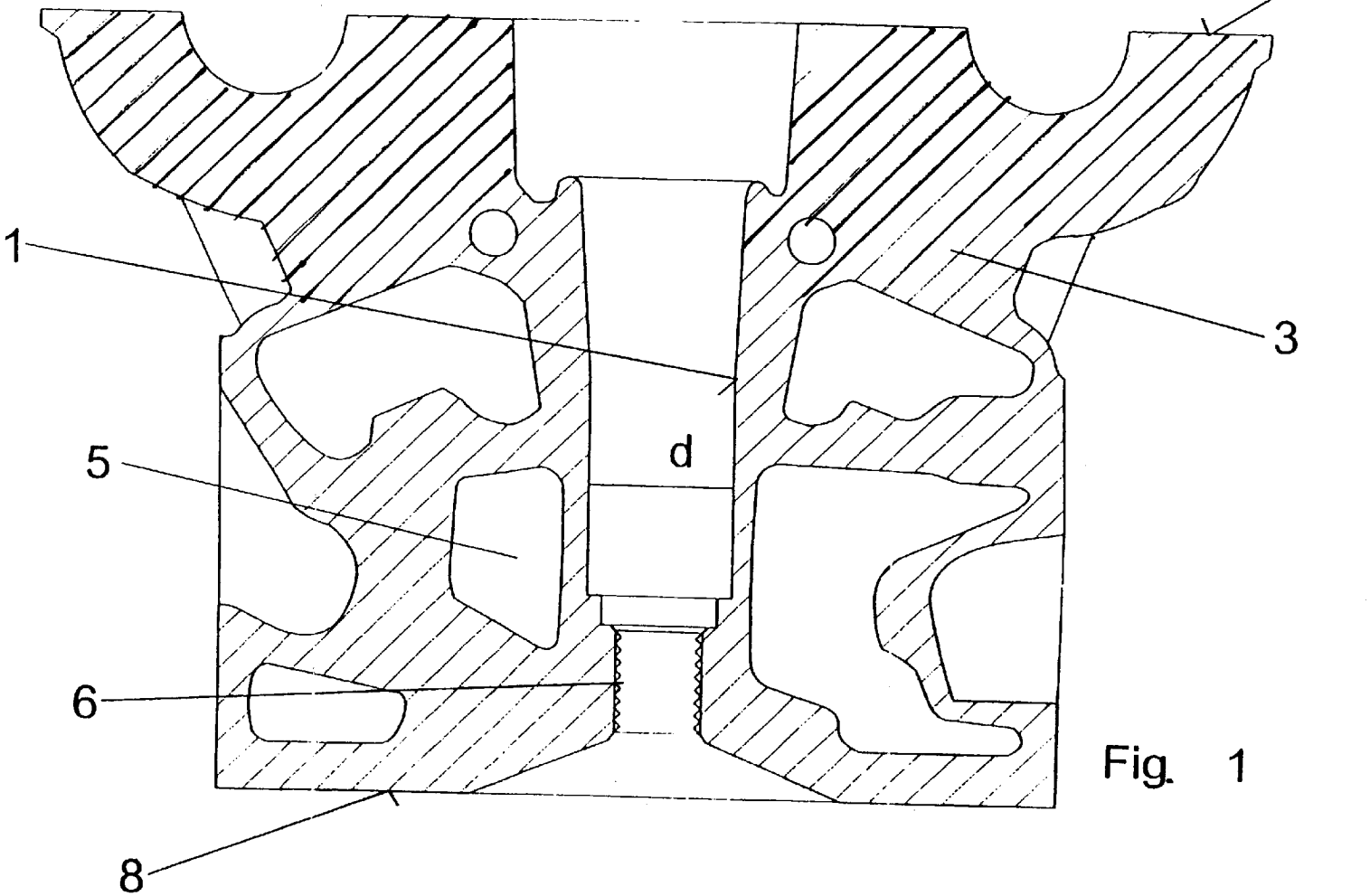
FIG. 1 is a sectional view through a cylinder head without a sleeve.

Referring to the drawings in particular, the design of a cylinder head according to the present invention and the sequence of the manufacture of such a cylinder head can be clearly explained on the basis of the figures. The cylinder block side is marked in the FIGS. 1 and 2 as the underside 8 of the cylinder head, while the side located opposite hereto is marked as the top side 7.

A plurality of recesses 5 are recessed in the cylinder head 3. The recesses 5 are used to reduce the weight and to transport the coolant circulating in them.

The central hole with the diameter "d" is the spark plug tube 1 before it is increased. In the lower section of the spark plug tube 1, i.e., in its bottom area, a thread 6 is prepared for fastening the spark plug. The spark plug was not shown in the figures for the sake of greater clarity. The spark plug tube 1 is increased to the diameter "D" by a machining process as shown in FIG. 2.

Figure 2:
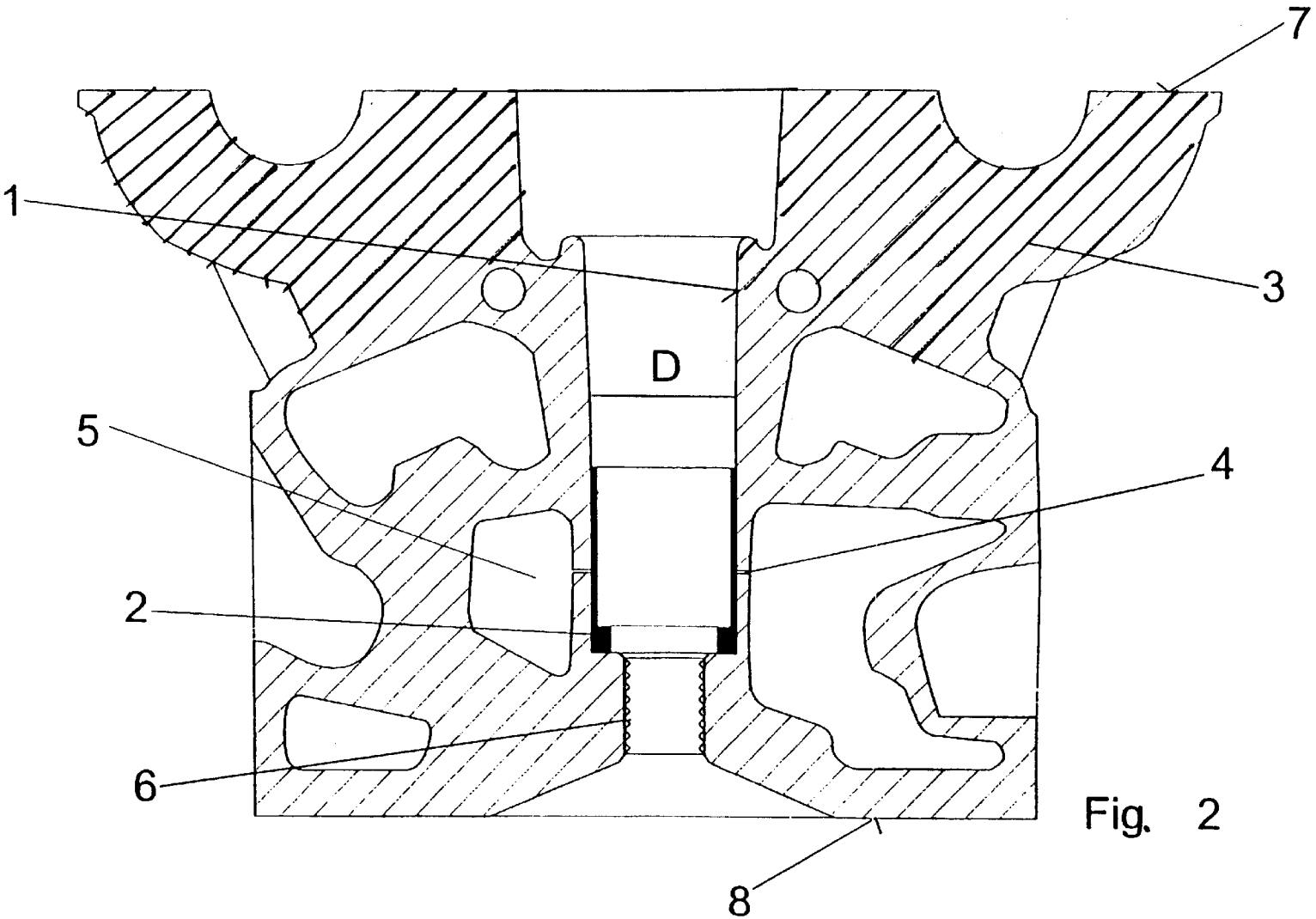
FIG. 2 is a sectional view through a cylinder head with a sleeve inserted into it.

The sleeve 2 can be subsequently inserted into the spark plug tube as shown in FIG. 2. Moreover, a permanently elastic sealant is introduced between the sleeve 2 and the spark plug tube.

Figure 3:
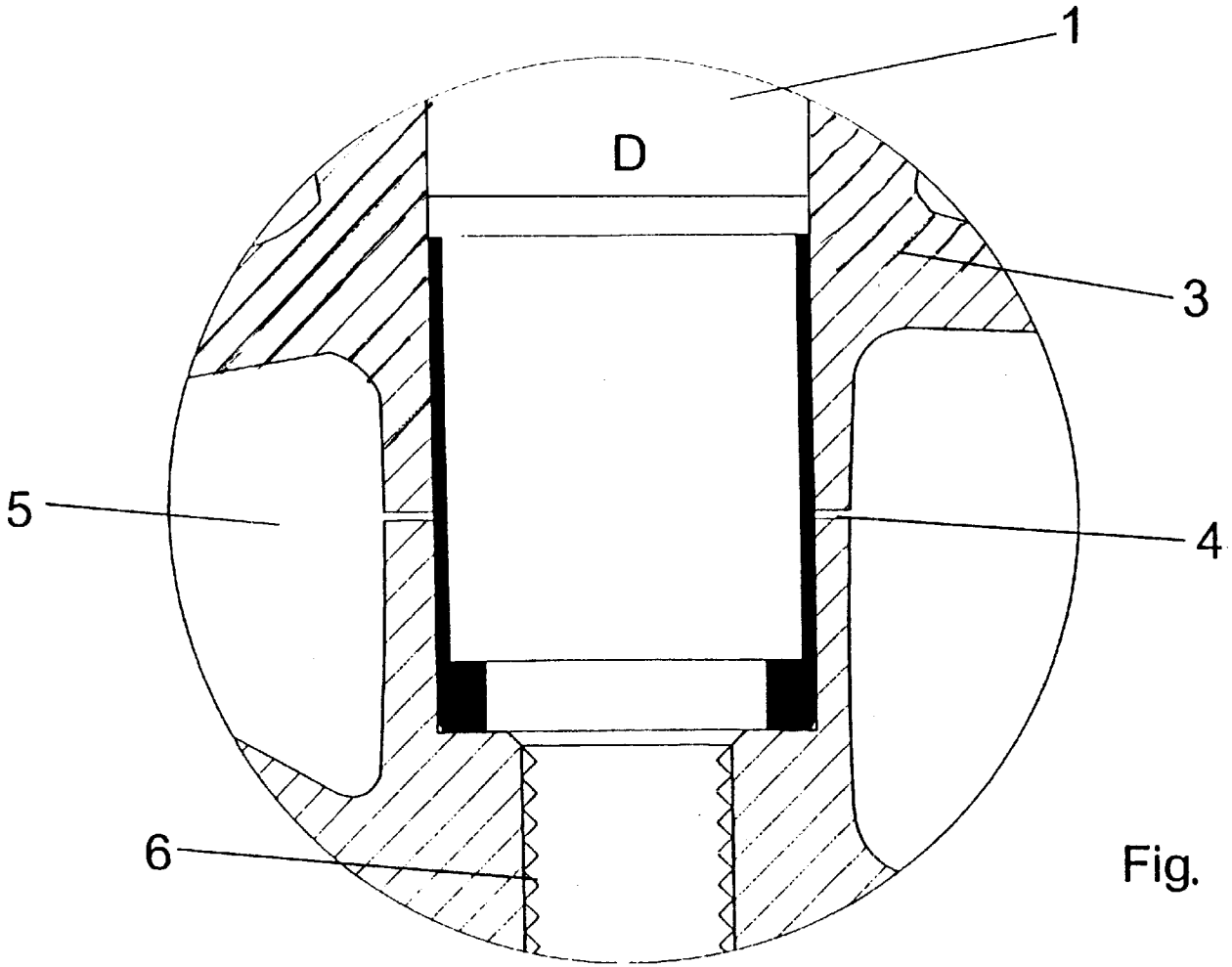
FIG. 3 is an enlarged detail of the area accommodating the sleeve.

The spark plug tube 1 is divided by a slot 4 at right angles to its longitudinal central axis as shown in FIGS. 2 and 3. This slot 4 may be milled in directly during the manufacture of a new cylinder head or it may be prepared later by means of a cutting tool. It preferably extends circularly, but it may also be provided in some sections only.

The internal diameter of the sleeve 2 is selected to be such that the spark plug can be inserted by means of a tool and it can be fastened in the thread 6 and can be removed from the thread 6.

While specific embodiments of the invention have been shown and described in detail to illustrate the application of the principles of the invention, it will be understood that the invention may be embodied otherwise without departing from such principles.

What is claimed is:

1. A cylinder head of an internal combustion engine, the cylinder head comprising:

a portion defining a spark plug tube for each cylinder, said spark plug tube having an end area facing the combustion chamber of the engine with a connection thread portion for screwing a spark plug into the cylinder head, said spark plug tube having an adjoining area adjoining said connection thread portion with an increased diameter, said adjoining area being open toward the outside of the engine, the cylinder head having a cavity adjacent to said adjoining area, said spark plug tube having a cut slot in said adjoining area extending through said spark plug tube to said cavity, said slot providing isolation between said adjoining area above said slot and said adjoining area below said slot.

2. A cylinder head of an internal combustion engine in accordance with claim 1, further comprising:

a permanently elastic sealant; and a sleeve inserted into the said spark plug tube and fixed in said spark plug tube by said permanently elastic sealant.

3. A cylinder head of an internal combustion engine in accordance with claim 2, wherein said sleeve has a length approximately corresponding to said spark plug tube.

4. A process for preparing a cylinder head with a portion defining a spark plug tube for each cylinder, said spark plug tube having an end area facing a combustion chamber of an engine with a connection thread portion for screwing a spark plug into the cylinder head, said spark plug tube having an adjoining area adjoining said connection thread portion with an increased diameter surrounded by a cavity, said adjoining area being open toward the outside of the engine and a sleeve in said adjoining area, the process comprising the steps of:

increasing an internal diameter (d) of said spark plug tube to a diameter (D) that is larger than an external diameter of said sleeve by a material-removing process;

cutting fully through the spark plug tube from an internal surface of said spark plug tube to said cavity with cut through sections extending at right angles to a longitudinal direction of said tube to form a slot in said adjoining area extending through said spark plug tube at right angles to a longitudinal direction of said spark plug tube, said slot providing isolation between said adjoining area above said slot an said adjoining area below said slot;

applying permanently elastic sealant to the sleeve;

introducing the sleeve into the spark plug tube positioning it therein.

5. A process in accordance with claim 4, wherein said sleeve has a length approximately corresponding to a length of said spark plug tube.

6. A cylinder head of an internal combustion engine, the cylinder head comprising:

a portion defining a plug passage for a cylinder, said plug passage having a first end area facing a combustion chamber of the engine, said plug passage having a second end area open to an outside of the engine, said first and second end areas of said plug passage being directly isolated from each other with respect to thermal expansion, said first and second end areas of said plug passage being spaced from each other by a slot in said portion of the cylinder head to provide isolation between said first and second end areas of said plug passage, said slot having a diameter larger than a diameter of said first and second areas of said plug passage adjacent to said slot; and a cavity defined by said portion of the cylinder head, said cavity being spaced from said plug passage, said slot extending from said plug passage to said cavity.

7. A cylinder head in accordance with claim 6, wherein:

said first and second end areas of said plug passage are homogenous with each other through said portion of the cylinder head.

8. A cylinder head in accordance with claim 6, wherein:

said cavity has a volume larger than a volume of said slot.

9. A cylinder head in accordance with claim 6, wherein:

said cavity is part of a passage in the cylinder head.

10. A cylinder head in accordance with claim 9, wherein:

said passage is a cooling passage.

11. A cylinder head in accordance with claim 6, wherein:

said slot extends at substantially right angles to a longitudinal direction of said plug passage.

12. A cylinder head in accordance with claim 6, wherein:

said cavity extends around and is spaced from said plug passage, said portion of the cylinder head being integral and substantially homogeneous and said first and second end areas of said plug passage being directly isolated from each other by a slot extending completely around said plug passage portion of the cylinder head and extending between said plug passage and said cavity.

13. A cylinder head in accordance with claim 6, further comprising:

a sleeve arranged in said plug passage;

an elastic sealant arranged between said first and second areas of said plug passage and said sleeve.

14. A cylinder head in accordance with claim 13, wherein:

said sleeve has a length approximately corresponding to said plug passage.

* * * * *